United States Patent [19]

Sakura et al.

[11] Patent Number: 4,808,135

[45] Date of Patent: Feb. 28, 1989

[54] CENTER ELECTRODE STRUCTURE FOR SPARK PLUG

[75] Inventors: Akio Sakura; Mitsutaka Yoshida; Junichi Kagawa, all of Nagoya, Japan

[73] Assignee: NGK Spark Plug Co., Ltd., Nagoya, Japan

[21] Appl. No.: 107,940

[22] Filed: Oct. 13, 1987

[51] Int. Cl.[4] ..... H01T 13/16; H01T 13/39

[52] U.S. Cl. ..... 445/7; 313/141

[58] Field of Search ..... 445/7; 313/141, 141.1

[56] References Cited

U.S. PATENT DOCUMENTS

| | | | |
|---|---|---|---|
| 2,406,966 | 9/1946 | Pfeil | 313/141.1 |
| 3,548,472 | 12/1970 | Urushiwara et al. | 445/7 |
| 3,857,145 | 12/1974 | Yamaguchi et al. | 445/7 |
| 4,093,887 | 6/1978 | Corbach et al. | 313/141 X |
| 4,400,643 | 8/1983 | Nishio et al. | 313/141 X |
| 4,684,352 | 8/1987 | Clark et al. | 445/7 |

*Primary Examiner*—Kenneth J. Ramsey

*Attorney, Agent, or Firm*—Cooper & Dunham

[57] ABSTRACT

In a center electrode structure for spark plug including a tublar insulator, the inner side of which has a stepped shoulder to provide a diameter-reduced bore therein; a center electrode having a flange, and concentrically placed into the insulator with the flange engaging against the shoulder, and with one end being axially through the bore so as to be exposed to outside of the insulator; the center electrode having an electrically conductive core of copper or copper-based alloy which is encased into an enclosure made of oxidation and heat resistant nickel-based alloy; and the core being provided with a number of fractures in its granular structure so as to absorb thermal stress due to the thermal expansional difference between the core and enclosure.

5 Claims, 2 Drawing Sheets

CENTER ELECTRODE STRUCTURE FOR SPARK PLUG

BACKGROUND OF THE INVENTION

1. Field of the Invention

This invention relates to a center electrode structure having an oxidation, heat resistant enclosure and an electrically conductive core member encased into the enclosure, and paticularly concerned to an improved center electrode structure so as to advantageously absorb thermal deformation due to thermal expansional difference therebetween, under high ambient temperature.

2. Description of the Prior Art

In a spark plug for an internal combustion engine, a center electrode exposes one end to a combustion chamber, so that it is subjected to a large quantity of heat and oxidation for an extended time period.

To endure against the adverse heat and oxidation environment, a center electrode is made from a copper-based core and a platinium or nickel-based enclosure clad by means of extrusion to ensure good electrical conduction, oxidation and heat resistivity simultaneouly. By way of illustration as taught by Japanese Patent No. 20614/1971 now public, the enclosure is previously purged and annealed for one hour at 650 degrees centigrade, at the same time, the core is also purged and pickled. The core thus pickled, is pressure fit into the enclosure in the air-tight relationship, and placed under the inert gaseous atmosphere at the temperature of 930 degrees centigrade for 1.5 hours so as to allow diffusion between the core and the enclosure.

The center electrode thus comprised, however, renders the platinium-based enclosure expensive, although advantageous in endurance and machining. In addition to it, the center electrode is subjected to deformation due to thermal stress between the core and the enclosure, thus leading to deviating from a normal discharge gap so as to be short of good and stable sparking action.

Therefore, it is an object of this invention to provide a center electrode structure which is capable of absorbing a thermal expansional difference between a core and enclosure members, protecting against inadvertent deformation to ensure good and stable sparking action for an extended time period with relatively low cost.

According to the invention, in a center electrode structure for spark plug comprising a tublar insulator, the inner side of which has a stepped shoulder to provide a diameter-reduced bore therein; a center electrode having a flange, and concentrically placed into the insulator with the flange engaging the shoulder, and with one end being axially through the bore to be exposed to outside of the insulator; the center electrode having an electrically conductive core member of copper or copper-based alloy which is encased into an enclosure made of an oxidation and heat resistant nickel-based alloy; and said core member being provided with a number of fractures in its granular structure so as to absorb thermal stress due to the thermal expansional difference between the core and enclosure members.

DESCRIPTION OF THE PREFERRED EMBODIMENT

In reference with the accompanied drawings, a preferred embodiment of this invention is described hereinafter.

Figure 1:
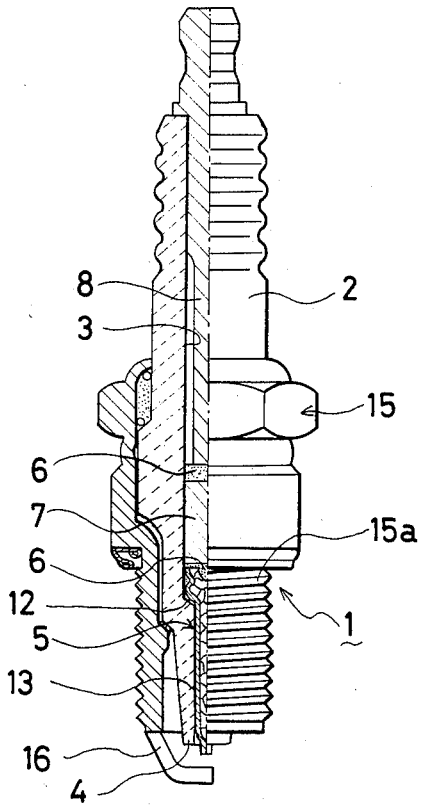
FIG. 1 is a longitudinal cross sectional view of a spark plug of the present invention.
Figure 2:
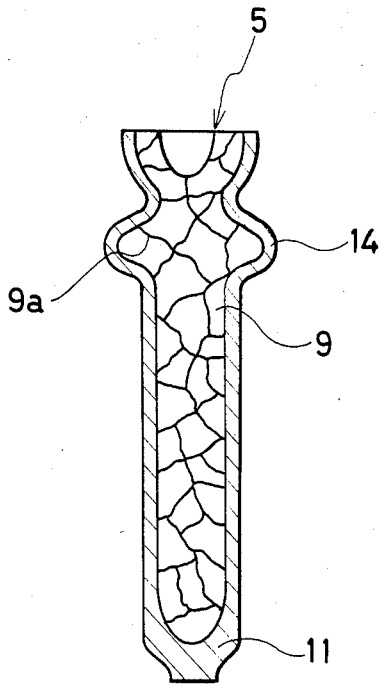
FIG. 2 is a longitudinal cross sectional view of a center electrode, but enlarged greater than that of FIG. 1.

As shown in FIG. 1, numeral 1 designates a whole structure of a spark plug according to this invention. An tublar insulator 2, which is made from ceramic such as alumina or the like, has a stepped shoulder 12 to provide a diameter-reduced top bore 13 which is in communication with an axial bore 3. Into the insulator 2, a center electrode 5 is placed which has a flange 14 engaging with the shoulder 12. The lower end of the center electrode 5 is protracted from the end of the insulator 2 to be exposed to the outside such as a combustion chamber when mounted on an internal combustion engine. At the upper end of the center electrode 5, an electrically conductive glass sealant 6, an electrical resistor 7 and a terminal 8 are thermally sealed at the temperature of 800–1100 degrees centigrade, as is well-known for those skilled in the art.

Further, noted that numeral 15 designates a metal shell having a thread 15*a*, through which spark plug is mounted on the engine. To the metal shell 15 is the insulator 2 secured by means of caulking. Numeral 16 is a ground electrode provided to form a spark gap with the lower end of the center electrode 5.

Figure 3:
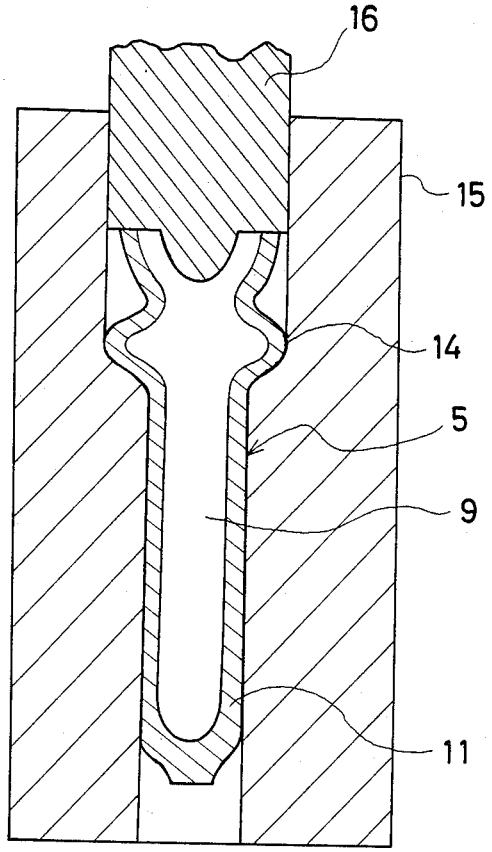
FIG. 3 is a longitudinal cross sectional view of a center electrode with an extruding machine.

Now, the center electrode 5 has a somewhat elongated core member 9, pressure-fit into an enclosure 11 which acts as a clad member, and finally formed by way of extrusion as seen in FIG. 3. The core member 9 is made from copper or copper-based alloy to impart an electrically conductive property, while the enclosure 11 being from a heat and oxidation resistant nickel-based alloy. The copper-based alloy may be preferably mixed with 0.01–1.0 weight percent of one or more than two elements selected among aluminum, silicon, manganese, titanium, zirconium or magnesium Meantime, the nickel-based alloy preferably may have additional elements of silicon, chrome, magnesium, aluminum, ferrous metal or the equivalent.

The center electrode 5 treats the core member 9 in methods as follows:

As first method, copper-based alloy with slight addition of such as magnesium(mg), manganese(Mn), silicon(Si), or aluminum(Al) is employed to the core member 9. After the core member 9 is encased into the enclosure member 11, and extruded to form the center electrode 5, heat treatment is carry out under the neutral or vacuum atmosphere at such temperature that the segregation of magnesium (Mg) causes to lower the melting point of granular boundry so as to form a plurality of fractures 9*a* in the core member 9.

As second method, hydrogen-embrittlement material such as electric copper, is employed to the core member 9. After the core member 9 is encased into the enclosure member 11, and extruded, the core member 9 together with the enclosure member 11 is treated under hydrogen atomspheric condition at the temperature of 700–800 degrees centigrade so as to cause fractures 9*a* at the granular boundary.

As third method, copper-based alloy is employed to the core member 9 on the one hand, alloy of nickel, chrome and ferrous metals (Inconel) is employed to the enclosure 11 on the other hand. After the core member 9 is encased into the enclosure member 11, and extruded, the center electrode 5 thus assembled, is heated under the neutral or vacuum atmospheric condition at the temperature of more than 900 degrees centigrade before the insulator 2 is mounted, and rapidly cooled. This results in the core member 9 appearing fractures 9*a* at the granular structure, since thermal expansion of the enclosure 11 is smaller than that of the core member 9.

With the structure thus far described, the center electrode 5 is exposed to the combustion chamber which is under high atomospheric temperature and high corrosive environment at the time of running the engine. In this instance, the core 9 and the enclosure 11 each individually deforms due to thermal expansional difference therebetween.

The expansional difference thus appeared between the core 9 and the enclosure 11 is, sufficiently absorbed by the void space of the fractures 9*a* so as to avoid the center electrode 5 against unfavorable deformation, thus leading to assuring a required space of spark gap continuously, maintaining an extended time period of its servicing life.

Below is a table to show how long period the center electrode 5 sustains from an adverse environment in a combustion chamber depending upon whether the core 9 is heat treated for fractures 9*a* or not.

In this table, a horizontal column shows composite material of core, enclosure and hours taken for center electrode to deform, while a vertical column being examples (1) through (6). Among these examples, the cases (2), (3), (5) and (6) is regarding to the present invention. The cases (1) and (4) are in connection with the prior art test piece.

Comparing the examples (2), (3), (5), (6) with the examples (1), (4), it is obviously proved that the examples according to the present invention, has been in use for longer time period such as from 650 up to 1000 (hrs.) without abnormal deformation.

TABLE

| test piece | core | enclosure | hours |
|---|---|---|---|
| example (1) | anhydrous copper wire | Ni—Si—Cr—Mn | 400 |
| example (2) | Cu with 0.5% Mg (heat treated at 1000 deg. 2 hrs). | Ni—Si—Cr—Mn | 800 |
| example (3) | electric copper treated by hydrogen-embrittlement for two hours | Ni—Si—Cr—Mn | 650 |
| example (4) | copper-based alloy (heat treated at 850 deg. 2 hrs.) | Inconel | 500 |
| example (5) | copper-based (heat treated at 900 deg. 2 hrs.) | Inconel | 800 |
| example (6) | copper-based alloy (heat treated at 1000 deg. 2 hrs.) | Inconel | 1000 |

As apparently understood from the foregoing description, the center electrode 5 is avoided from being abnormally deformed in a degree to change the spark gap, due to the fact that the thermal expansional difference between the core 9 and the enclosure 11, is preferably absorbed by void space of the fractures 9*a*, thus conducive to an extended period of servicing life.

It should be appreciated that although the heat treatment allows to fracture the granular structure of the core, the void space of the fracture is very minute so as to always ensure good electrical conduction and high rigidity as a whole.

The present invention is further described in the claims which follows:

What is claimed is:

1. In a center electrode structure for spark plug including a tublar insulator, the inner side of which has a stepped shoulder to provide a diameter-reduced bore therein; a center electrode having a flange and concentrically placed into said insulator with said flange engaging against said shoulder and with one end being axially through said bore so as to be exposed to outside of said insulator;

said center electrode having an electrically conductive core member of copper or copper-based alloy which is tightly encased into an enclosure member made of an oxidation and heat resistant nickel-based alloy; and said core member being provided with a number of fractures in its granular structure so as to absorb thermal stress due to the thermal expansional difference between said core and enclosure members.

2. In a center electrode structure for spark plug as recited in claim 1, said core member is provided with fractures by conducting heat treatment.

3. In a center electrode structure for spark plug as recited in claim 2, intergranular fractures are adapted to be introduced at the grain structure of said core member.

4. In a center electrode structure for spark plug as recited in claim 2, said core member is provided with fractures at the grain boundry.

5. In a center electrode structure for spark plug as recited in claim 1, said enclosure is of alloy from nickel, chrome and ferrous metals.

* * * * *